US006536522B2

(12) United States Patent
Birckhead et al.

(10) Patent No.: US 6,536,522 B2
(45) Date of Patent: Mar. 25, 2003

(54) ARTIFICIAL LIFT APPARATUS WITH AUTOMATED MONITORING CHARACTERISTICS

(75) Inventors: John M. Birckhead, Spring, TX (US); Art Britton, Lecherias (VE)

(73) Assignee: Weatherford/Lamb, Inc., Houston, TX (US)

( * ) Notice: Subject to any disclaimer, the term of this patent is extended or adjusted under 35 U.S.C. 154(b) by 0 days.

(21) Appl. No.: 09/790,855

(22) Filed: Feb. 22, 2001

(65) Prior Publication Data

US 2002/0074127 A1 Jun. 20, 2002

Related U.S. Application Data

(60) Provisional application No. 60/184,210, filed on Feb. 22, 2000.

(51) Int. Cl.[7] ..... E21B 43/00; E21B 47/06

(52) U.S. Cl. ..... 166/250.15; 166/250.03; 166/250.01

(58) Field of Search ..... 166/250.03, 250.07, 166/250.15, 68.5, 72, 105.1, 250.01, 372, 53; 417/22, 42

(56) References Cited

U.S. PATENT DOCUMENTS

| | | | | | |
|---|---|---|---|---|---|
| 3,266,574 | A | | 8/1966 | Gandy | 166/53 |
| 3,396,793 | A | | 8/1968 | Piper et al. | 166/53 |
| 3,678,997 | A | | 7/1972 | Barchard | 166/53 |
| 3,863,714 | A | | 2/1975 | Watson, Jr. | 166/53 |
| 4,461,172 | A | * | 7/1984 | McKee et al. | 166/250.15 |
| 4,989,671 | A | | 2/1991 | Lamp | 166/53 |
| 5,132,904 | A | * | 7/1992 | Lamp | 166/53 |
| RE34,111 | E | | 10/1992 | Wynn | 166/53 |
| 5,314,016 | A | * | 5/1994 | Dunham | 166/250.15 |
| 5,517,593 | A | * | 5/1996 | Nenniger et al. | 166/250.11 |
| 5,622,223 | A | * | 4/1997 | Vasquez | 166/100 |
| 5,634,522 | A | * | 6/1997 | Hershberger | 166/372 |
| 5,636,693 | A | | 6/1997 | Elmer | 166/370 |
| 5,735,346 | A | | 4/1998 | Brewer | 166/250.03 |
| 5,873,411 | A | * | 2/1999 | Prentiss | 166/105 |
| 5,878,817 | A | | 3/1999 | Stastka | 166/372 |
| 5,941,305 | A | * | 8/1999 | Thrasher et al. | 166/53 |
| 5,996,691 | A | * | 12/1999 | Norris et al. | 166/250.03 |
| 6,196,324 | B1 | | 3/2001 | Giacomino et al. | 166/372 |
| 6,293,341 | B1 | | 9/2001 | Lemetayer | 166/250.15 |

FOREIGN PATENT DOCUMENTS

| | | | |
|---|---|---|---|
| EP | 0 668 492 A2 | 8/1995 | G01M/3/26 |
| WO | 97/16624 A | 5/1997 | E21B/34/16 |
| WO | 97/46793 A | 12/1997 | E21B/47/10 |

OTHER PUBLICATIONS

PCT International Search Report from International Application No. PCT/GB01/04488, Dated Apr. 16, 2002.

PCT International Search Report from PCT/GB01/00778, Dated Aug. 13, 2001.

* cited by examiner

*Primary Examiner*—David Bagnell
*Assistant Examiner*—T. Shane Bomar
(74) *Attorney, Agent, or Firm*—Moser, Patterson & Sheridan, L.L.P.

(57) ABSTRACT

The present invention provides an artificial lift apparatus that monitors the conditions in and around a well and makes automated adjustments based upon those conditions. In one aspect, the invention includes a pump for disposal at a lower end of a tubing string in a cased wellbore. A pressure sensor in the wellbore adjacent the pump measures fluid pressure of fluid collecting in the wellbore. Another pressure sensor disposed in the upper end of the wellbore measures pressure created by compressed gas above the fluid column and a controller receives the information and calculates the true height of fluid in the wellbore. Another sensor disposed in the lower end the tubing string measures fluid pressure in the tubing string and transmits that information to the controller. The controller compares the signals for the sensors and makes adjustments based upon a relationship between the measurements and preprogrammed information about the wellbore and the formation pressure therearound.

31 Claims, 1 Drawing Sheet

ARTIFICIAL LIFT APPARATUS WITH AUTOMATED MONITORING CHARACTERISTICS

This application claims priority to Provisional U.S. Patent Application No. 60/184,210 filed on Feb. 22, 2000, which is hereby incorporated by reference in its entirety, which is not inconsistent with the disclosure herein.

BACKGROUND OF THE INVENTION

1. Field of the Invention

The present invention relates to a lift apparatus for artificial lift wells. More particularlly, the invention relates to an apparatus that monitors conditions in a well and makes automated adjustments based upon those conditions.

2. Background of the Related Art

In the recovery of oil from an oil well, it is often necessary to provide a means of artificial lift to lift the fluid upwards to the surface of the well. For example, when an oil-bearing formation has so little natural pressure that the oil is unable to reach the surface of the well after entering a wellbore through perforations formed in the wellbore casing. As the oil from the formation enters the wellbore, a column of fluid forms and the hydrostatic pressure of the fluid increases with the height of the column. When the hydrostatic pressure in the wellbore approaches the formation pressure of the well, i.e., the pressure acting upon production fluid to enter the wellbore, the oil may be prevented from entering the formation and its flow may be reversed. The resulting back flow may carry fluid and sand back into the formation and prevent future production into the wellbore. To avoid this problem, conventional wells utilize tubing coaxially disposed in the wellbore with a pump at a lower end thereof to pump wellbore fluid to the surface and reduce the column of fluid in the wellbore.

Artificial lift pumps include progressive cavity (PCP) pumps having a rotor and a stator constructed of dissimilar materials and with an interference fit therebetween. PCPs are operated from the surface of the well with a rod extending from a motor to the pump. The motor rotates the rod and that rotational force is transmitted to the pump. Effective and safe operation of artificial lift wells as those described above require an optimum amount of fluid be in the wellbore at all times. As stated above, the fluid column must not rise above a certain level or its weight and pressure will damage the formation and kill the well. Conversely, PCPs require fluid to operate and the pump can be damaged if the fluid level drops below the intake of the pump, leading to pump cavitation and pump failure due to friction between the moving parts.

To ensure that the optimum fluid level is maintained in the wellbore, conventional artificial lift wells utilize pressure sensors and automated controllers to monitor the fluid and pressure present in the wellbore. The pressure sensors are located at or near the bottom of the wellbore and the controller is typically located at the surface of the well. The controller is connected to the sensors as well as the PCP. By measuring the pressure in the annular area between the production tubing and the casing wall and by comparing that pressure to a known formation pressure for the well, the controller can operate a PCP in a manner that maintains the wellbore pressure at a safe level. Additionally, by knowing dimensional characteristics of the wellbore, the height of fluid can be calculated and the controller can also operate the pump in a manner that ensures an adequate about of fluid covers the PCP.

The conventional apparatus operates in the following manner: As the pressure in the wellbore approaches a predetermined value based upon the formation pressure of the well, the controller causes the pump speed to increase by increasing the speed of the motor. As a result, additional fluid is evacuated from the wellbore into the tubing and transported to the surface, thereby reducing the column of the fluid in the wellbore and also reducing the chances of damage to the well. If the hydrostatic pressure at the bottom of the wellbore becomes too low, the controller causes the speed of the pump to decrease to insure that the pump remains covered with fluid and has a source of fluid to pump.

There are problems associated with artificial lift apparatus like the one described above. One problem arises with the use of filters at the lower end of the production tubing string. The filters are necessary to eliminate formation sand and other particulate matter from the production fluid entering the tubing string. Filters typically include a perforated base pipe, fine woven material therearound and a protective shroud or outer cover. The filters are designed to be disposed on the tubing string below the pump in order to filter production fluid before it enters the pump. However, as the filters operate, they can become clogged and restrict the flow of fluid into the pump. The result of a clogged filter in the automated apparatus described above can be catastrophic due to the system's inability to distinguish a clogged filter from some other wellbore condition needing an automated adjustment. For instance, with a clogged filter, the pump is unable to operate effectively and the fluid level in the wellbore increases. With this increase comes an increase in pressure and a signal from the controller to the pump motor to increase the speed of the pump. Rather than reduce the wellbore pressure, the pump continues to operate ineffectively due to the clogged filter and the pump motor begins to overheat as it provides an ever-increasing amount of power to the pump. Meanwhile, the fluid level in the wellbore continues to rise towards the formation pressure of the well. The combination of the increasing pump speed and the pump's inability to pass fluid causes the pump to fail. After the pump fails, the wellbore is left to fill with oil and cause damage to the well.

Another problem associated with the forgoing conventional apparatus relates to the measurement of the annulus pressure. As fluid collects in the wellbore of an artificial lift well, air above the fluid column in the wellbore is compressed due to the fact that the upper end of the wellbore is typically sealed. As the air is compressed, the air pressure necessarily acts upon the fluid column therebelow and also upon the pressure sensor located at the bottom of the wellbore. The result is a pressure reading at the lower casing sensor that is a measure of not only fluid pressure but also of air pressure. While this combination pressure is useful in determining the overall pressure acting upon the formation, it is not an accurate measurement of the height of the fluid column in the wellbore. Therefore, depending upon the amount and pressurization of air in the upper part of the wellbore, an inaccurate calculation of fluid height results. Because the calculation of fluid height is critical in operating the well effectively and safely, this can be a serious problem.

There is a need therefore, for an artificial lift well that can be operated more effectively and more safely than conventional artificial lift wells. There is a further need for an apparatus to operate an artificial left well wherein a number of variables are monitored and controlled by a controller to ensure that the formation around the wellbore is not damaged and continues to produce. There is yet a further need for an artificial lift apparatus to ensure the safety of PCP pumps.

SUMMARY OF THE INVENTION

The present invention provides an artificial lift apparatus that monitors the conditions in and around a well and makes automated adjustments based upon those conditions. In one aspect, the invention includes a pump for disposal at a lower end of a tubing string in a cased wellbore. A pressure sensor in the wellbore adjacent the pump measures fluid pressure of fluid collecting in the wellbore. Another pressure sensor disposed in the upper end of the wellbore measures pressure created by compressed gas above the fluid column and a controller receives the information and calculates the true height of fluid in the wellbore. Another sensor disposed in the lower end the tubing string measures fluid pressure in the tubing string and transmits that information to the controller. The controller compares the signals for the sensors and makes adjustments based upon a relationship between the measurements and preprogrammed information about the wellbore and the formation pressure therearound. In another aspect the invention includes additional sensors for measuring the torque and speed of a motor operating a progressive cavity pump ("PCP"). In another aspect the invention includes a method for controlling an artificial lift well including measuring the wellbore pressure at an upper and lower end, measuring the tubing pressure at a lower end and comparing those values to each other and to preprogrammed values to operate the well in a dynamic fashion to ensure efficient operation and safety to the well components.

BRIEF DESCRIPTION OF THE DRAWINGS

So that the manner in which the above recited features, advantages and objects of the present invention are attained and can be understood in detail, a more particular description of the invention, briefly summarized above, may be had by reference to the embodiments thereof which are illustrated in the appended drawings.

It is to be noted, however, that the appended drawings illustrate only typical embodiments of this invention and are therefore not to be considered limiting of its scope, for the invention may admit to other equally effective embodiments.

DETAILED DESCRIPTION OF THE PREFERRED EMBODIMENT

Figure 1:
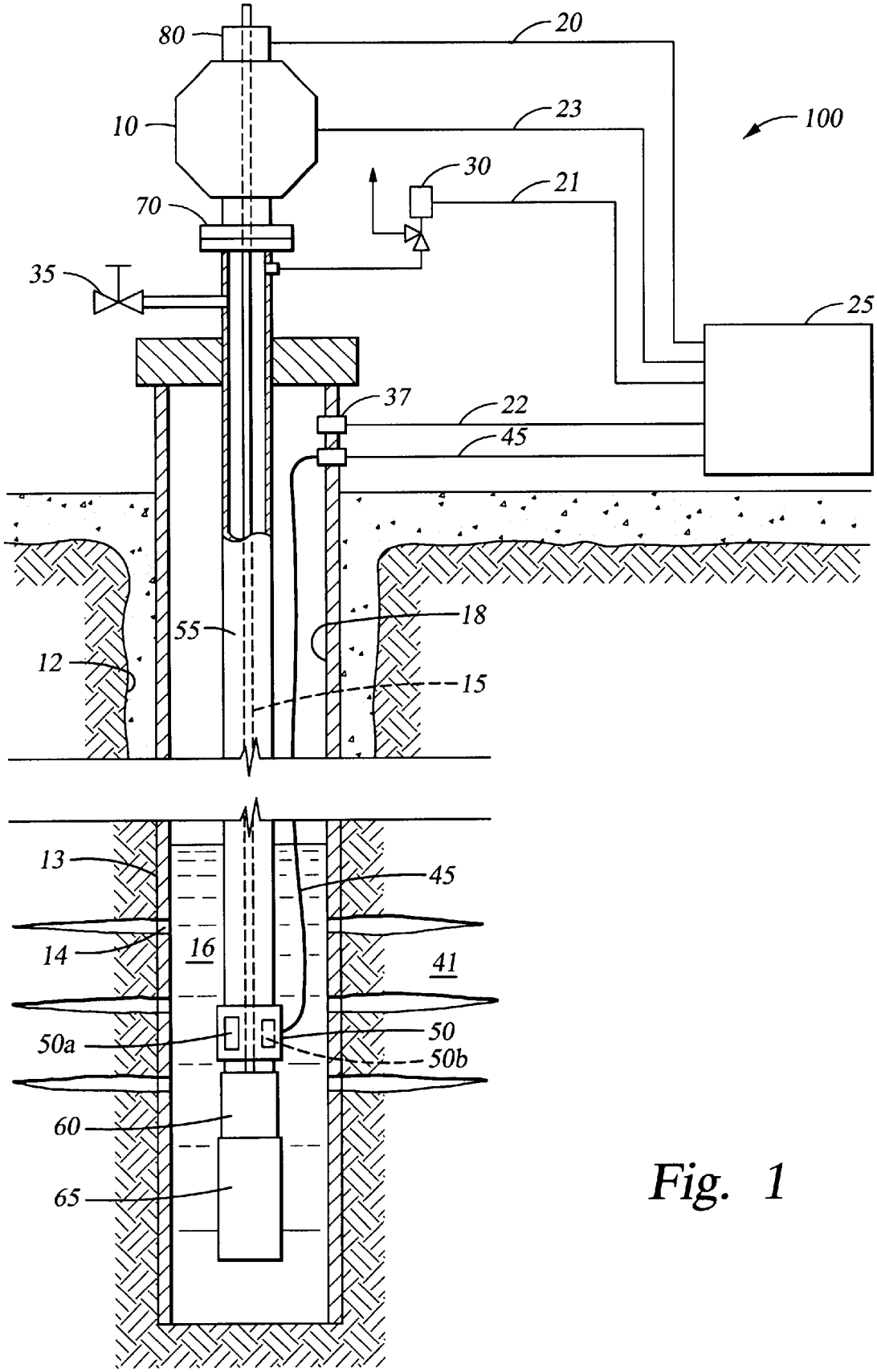
FIG. 1 is a partial section view of a wellbore showing an artificial lift apparatus according to the present invention.

FIG. 1 is a partial section view of an automated lift apparatus 100 of the present invention. A borehole 12 is lined with casing 13 to form a wellbore 18 that includes perforations 14 providing fluid communication between the wellbore 18 and a hydrocarbon-bearing formation 41 therearound. A string of tubing 55 extends into the wellbore 18 forming an annular area 16 therebetween. The tubing string 55 is fixed at the surface of the well with a tubing hanger (not shown) and is sealed as it passes through a flange 70 at the surface of the well. A valve 35 extends from the tubing 55 at an upper end thereof and leads to a collection point (not shown) for collection of production fluid from the wellbore 18. An upper tubing pressure sensor 30 also extends from the tubing 55 at the surface of the well 18 to measure pressure in the tubing at the surface. Included in the sensor assembly is a relief valve to vent the contents of the tubing in an emergency. At the upper end of the casing 13 is an upper casing sensor 37 to measure the pressure in the upper portion of annulus 16. Each of the sensors 30 and 37 are electrically connected to a controller 25 by control lines 21, 22 respectively.

At the downhole end of the wellbore 18, a gauge housing 50 is connected to the tubing string 55 and includes a downhole casing pressure sensor 50*a* and a downhole tubing pressure sensor 50*b*. The casing pressure sensor 50*a* is constructed and arranged to measure the pressure in annulus 16 and is connected electrically to the controller 25 via control line 45. The tubing pressure sensor 50*b* is constructed and arranged to measure fluid pressure in the lower end of the tubing string 55 adjacent pump 60 and is also electrically connected to the controller 25 via control line 45. Disposed on the tubing string 55 below the gauge housing 50 is a pump 60. In one embodiment, the pump 60 is a progressive cavity pump (PCP) and is operated with rotational force applied from a rod 15 which extends between a motor 10 at the surface of the well and a sealed coupling (not shown) on the pump 60. As illustrated in FIG. 1, the rod 15 is housed coaxially within tubing string 55. Below the motor 10, also disposed on the tubing string 55 is a filter 65 to filter particulate matter from production fluid pumped from annulus 16 into the tubing 55 and to the surface of the well. Adjacent the electric motor 10 at the surface is a torque and speed sensor 80, which is connected to the controller 25 via a motor input signal line 20.

In operation, the apparatus 100 operates to artificially lift production fluid from the wellbore 18 through the tubing string 55 to a collection point. Specifically, production fluid migrates from formation 41 through perforations 14 and collects in the annulus 16. The downhole casing pressure sensor 50*a* monitors the pressure of the fluid column ("the annulus pressure") and transmits that value to the controller 25 via control line 45. Similarly, the upper casing pressure sensor 37 measures the pressure at the top of the casing 13 and transmits that value to the controller 25 via control line 22. The controller 25, using preprogrammed instructions and formulae, determines the true height of fluid in the wellbore 18 and operates the pump 60 based upon preprogrammed instructions that are typically based upon historical data and formation pressure. As the pump 60 operates, fluid making up a column in annulus 16 enters the filter 65, flows through the pump 60, and passes through gauge housing 50. As the fluid passes the gauge housing 50, the downhole tubing pressure is measured by the downhole tubing sensor 50*b* and is transmitted to the controller 25 via control line 45.

After the controller 25 receives the pressure values, the controller 25 compares the pressure values to preset or historically stored values relating to the formation pressure of the well. Specifically, if the value of the annulus pressure approaches the preset values, the controller 25 sends a signal to the pump 60 through a command line 23 to increase the speed of the pump 60 in order to decrease the column of fluid in the casing 13 and effect a corresponding decrease in pressure as measured by the downhole casing pressure sensors 50*a*. Conversely, if the controller 25 receives an annulus pressure value indicative of a situation wherein the pump 60 is nearly exposed to air, the controller 25 will command the pump 60 to decrease its speed in order for the column of fluid in the wellbore 18 to increase and ensure the pump 60 is covered with fluid thereby avoiding damage to the pump 60. The controller 25 also monitors the surface casing pressure so that it might be considered by the controller 25 in determining the true height of fluid in the wellbore 18. By monitoring surface pressure, the controller 25 can compensate for variables like compressed gas, as previously described.

Similarly, the downhole tubing pressure is constantly monitored by the controller 25. The controller 25 can recognize malfunctions of the pump 60 or its inability to pass well fluid due to a filter 65 problem. For example, if the filter 65 becomes clogged, the pressure within the tubing 55 will decrease and this change will be transmitted to the controller 25 from the downhole tubing pressure sensor 50*b*. Rather than simply command the pump 60 to increase its speed and risk pump 60 failure, the controller 25 will also take the annulus pressure reading into account. In this manner, the controller 25 can recognize that the annulus pressure has not decreased and, in the alternative, perform a preprogrammed set of commands including a shut down or partial shut down of the pump 60. The set of commands can also include a signal to maintenance personnel alerting them to a potentially damaged filter 65 or other problem.

In addition to the forgoing operations, the controller 25 also constantly monitors the speed and torque of the motor 10. Signals from the torque and speed sensor 80 are communicated to the controller 25 through the motor input line 20. Information from the sensor 80 is used to determine whether to increase or decrease the pump speed in relation to signals from the pressure gauges that require the level of fluid in the casing 13 to be adjusted. Additionally, through the speed and torque sensor 80, the controller 25 can monitor and correct conditions like over torque on the shaft 15. For example, the comparison of speed to torque can illustrate a problem if the torque increases without an increase in motor speed.

While foregoing is directed to the preferred embodiment of the present invention, other and further embodiments of the invention may be devised without departing from the basic scope thereof, and the scope thereof is determined by the claims that follow.

What is claimed is:

1. An artificial lift apparatus for a wellbore, comprising:

a tubular for extending into the wellbore, a lower end of the tubular constructed and arranged to receive production fluid for transportation to a surface of the wellbore;

a pump disposed proximate the lower end of the tubular, the pump for transporting the fluid upwards in the tubular;

a controller;

a lower annulus pressure sensor for measuring a lower annulus pressure magnitude in a lower part of an annulus of the wellbore and transmitting the magnitude to the controller; and an upper annulus pressure sensor for measuring an upper annulus pressure magnitude in an upper part of the annulus and transmitting the magnitude to the controller.

2. The apparatus of claim 1, comprising a lower tubing pressure sensor for measuring a lower tubing pressure magnitude in the lower part of the tubular and transmitting the magnitude to the controller.

3. Thee apparatus of claim 1, wherein the pump is a progressive cavity pump and is operated by a drive rod extending from a motor disposed at the surface of the wellbore.

4. The apparatus of claim 1, wherein the controller receives at least one input from the lower annulus pressure sensor and compares at least one input to at least one stored value.

5. The apparatus of claim 4, wherein the at least one stored value include historical operating characteristics of the wellbore.

6. The apparatus of claim 5, wherein the at least one stored value include the formation pressure of the well.

7. The apparatus of claim 4, wherein the controller distinguishes a fluid pressure in the annulus from a gas pressure in the annulus.

8. The apparatus of claim 7, further comprising a filter disposed on the tubular and below the pump.

9. The apparatus of claim 8, wherein the lower tubing pressure sensor operates and transmits pressure values of fluid in the tubular.

10. The apparatus of claim 9, wherein the controller compares tubing pressure changes to annulus pressure changes.

11. The apparatus of claim 8, wherein the controller can recognize pump malfunctions or problems with the filter by constantly monitoring the lower tubing pressure magnitude measured by the lower tubing pressure sensor.

12. The apparatus of claim 1, wherein the controller can determine a fluid height in the annulus by comparing a gas pressure magnitude in the annulus measured by the upper annulus pressure sensor and a combined fluid and gas pressure magnitude in the annulus measured by the lower annulus pressure sensor to each other and to preprogrammed values.

13. The apparatus of claim 1, wherein the controller adjusts the pump speed in response to the lower and/or upper annulus pressure signals.

14. An artificial lift apparatus for a well, comprising:

at least one tubular string at least partially disposed in the well;

a first pressure gauge disposed in an upper part of the annulus;

a second pressure gauge disposed in a lower part of the annulus and connected to the at least one tubular string;

a pump disposed below the second pressure gauge; and a control member for receiving at least one signal from each pressure gauge and controlling the pump in response to the signals.

15. The apparatus of claim 14, wherein the second pressure gauge comprises:

a casing pressure gauge; and a tubing pressure gauge.

16. The apparatus of claim 15, wherein the control member separates and recognizes an annulus pressure signal and a tubing pressure signal.

17. The apparatus of claim 16, wherein the controller can recognize pump malfunctions or problems with a filter disposed on the tubular and below the pump by constantly monitoring the tubing pressure magnitude measured by the tubing pressure gauge.

18. The apparatus of claim 14, wherein the control member adjusts the pump speed in response to an annulus pressure signal.

19. The apparatus of claim 14, wherein the control member adjusts the pump speed in response to a tubing pressure signal.

20. The apparatus of claim 14, further comprising:

a tubing hanger disposed on the surface of the wellbore and connected to the at least one tubular string;

an electric motor disposed on the surface of the well; and a shaft extending from the electric motor to the pump.

21. The apparatus of claim 20, further comprising:

a torque and speed sensor connected to the electric motor; and a motor input signal line extending from the torque and speed sensor to the control member.

22. The apparatus of claim 20, further comprising a command line extending from the control member to the electric motor.

23. The apparatus of claim 14, wherein the pump is a progressive cavity pump.

24. The apparatus of claim 14, further comprising a control line for transmitting the at least one signal from the pressure gauge to the control member.

25. The apparatus of claim 14, wherein the first pressure gauge is an upper casing pressure gauge communicatively coupled with the control member.

26. The apparatus of claim 14, further comprising:

an electric motor disposed on the surface of the well, the electric motor being communicatively coupled with the control member.

27. The apparatus of claim 14, wherein the control member can determine a fluid height in the annulus by comparing a gas pressure magnitude in the annulus measured by the first pressure gauge and a combined fluid and gas pressure magnitude in the annulus measured by the second pressure gauge to each other and to preprogrammed values.

28. A method of operating an artificial lift well, comprising:

measuring a fluid pressure at a lower end of a well annulus;

measuring a gas pressure at an upper end of the well annulus;

transmitting the pressures to a controller; and using the pressures and a preprogrammed data to determine a fluid height in the annulus.

29. The method of claim 28, further including adjusting a speed of a pump motor based upon the fluid height in the annulus.

30. The method of claim 29, further including adjusting the speed of the pump motor to insure the pump operates with a source of fluid.

31. A method of operating an artificial lift well, comprising:

measuring a lower annulus pressure;

measuring an upper annulus pressure;

measuring a lower tubing pressure;

transmitting the pressures to a controller;

comparing the pressures; and performing a preprogrammed set of instructions if the lower annulus pressure increases over time without a relative, corresponding increase in the lower tubing pressure.

* * * * *